United States Patent [19]

Smith et al.

[11] 4,054,073

[45] Oct. 18, 1977

[54] JEWELER'S TOOL

[76] Inventors: Howard H. Smith, No. 4 W. Lake Place, Antioch, Calif. 94509; Glenn E. Christensen, 175 A South Ave., Pittsburg, Calif. 94565

[21] Appl. No.: 743,564

[22] Filed: Nov. 22, 1976

[51] Int. Cl.[2] ..... B26D 1/30; B26D 3/00

[52] U.S. Cl. ..... 83/599; 83/54; 83/605; 83/917; 83/925 R

[58] Field of Search ..... 83/598, 599, 594, 595, 83/605, 917, 925 R, 54

[56] References Cited

U.S. PATENT DOCUMENTS

| | | | |
|---|---|---|---|
| 2,437,397 | 5/1953 | Welk | 83/598 X |
| 3,996,782 | 12/1976 | Sgariglia | 83/605 X |

*Primary Examiner*—Willie G. Abercrombie
*Attorney, Agent, or Firm*—Phillips, Moore, Weissenberger, Lempio & Majestic

[57] ABSTRACT

A cutting tool is provided with a plurality of circular cutting blades of varying predetermined thicknesses to shear sections from rings made of precious metals. Each blade is formed with a notched perimeter to provide a pair of blade cutting edges. The blades are mounted on a spindle for rotation therewith, while the spindle is rotatably mounted in a plurality of cutting blocks which are affixed to a base in an alternating arrangement with the aforesaid blades. The cutting blocks define cutting edges so that rotation of the spindle causes the blade cutting edges formed by the notched perimeter to come into a simultaneous shearing relation with the cutting edges of the two adjacent cutting blocks. Further rotation of the spindle will shear out a section of a ring interposed in the notched perimeter of the blade. The tool is further provided with removable trays to catch sheared pieces of precious metals. Rotation of the spindle is accomplished through a conventional crank handle.

10 Claims, 4 Drawing Figures

FIG. 3.
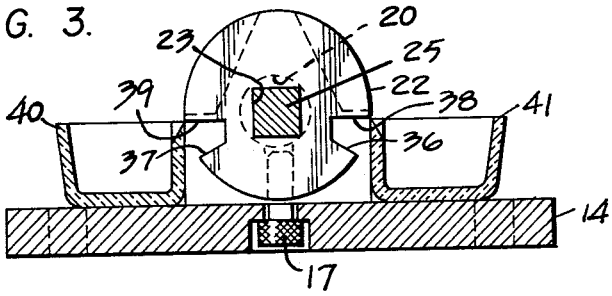
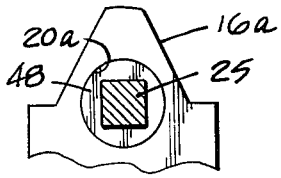
FIG. 4.
FIG. 2.
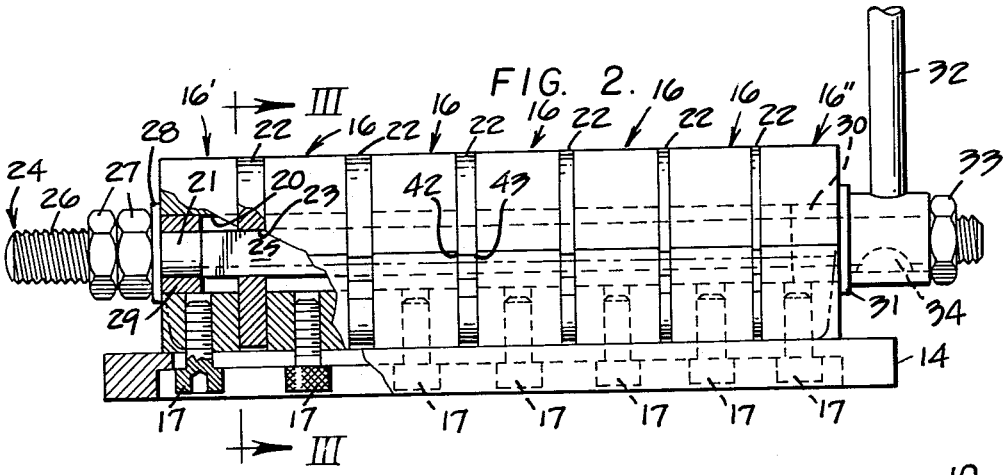
FIG. 1.
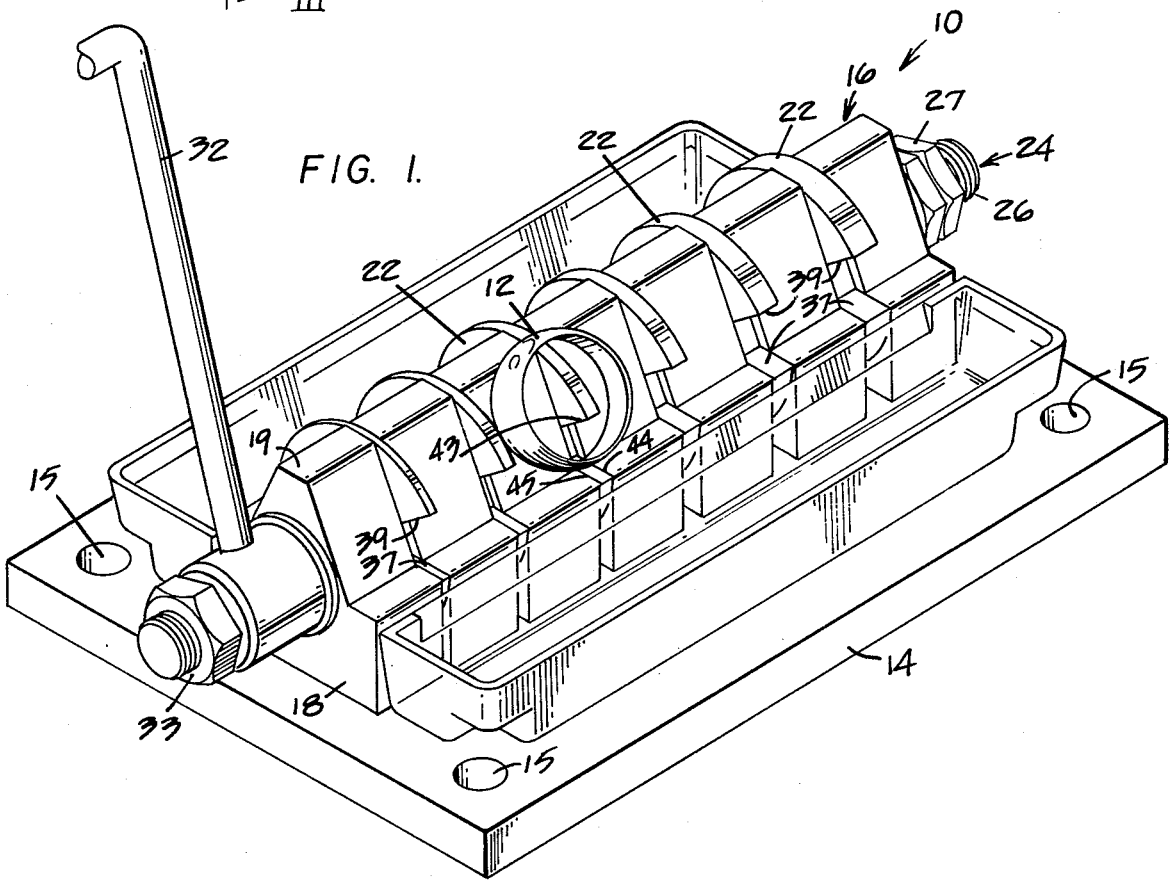

JEWELER'S TOOL

BACKGROUND OF THE INVENTION

This invention relates to a tool for use by jewelers in sizing rings. Specifically it relates to a tool for cutting portions of precious metals from a ring with a minimum wastage of precious metals.

The sizing of decorative rings by jewelers involves cutting the ring at some point with some tool adapted for such cutting. Conventionally a saw is used which leaves a kerf of predetermined width. Conceivably saws of varying set to provide differing kerfs could be used in order to provide a gap in the original ring when decreasing the size of the ring a predetermined amount. When increasing the size of the ring, the kerf should be kept as narrow as possible to minimize loss of precious metal resulting from the sawing of the metal. Shearing tools may also be utilized, however a certain degree of deformation may occur in the cut necessitating the use of a file to provide an edge perpendicular to the perimeter of the ring to enable fusing together of the cut surfaces. When decreasing the size of the ring it is most appropriate to attempt to get the two cuts generally parallel so that the ring may be readily joined by conventional soldering.

A problem arises with a jeweler who does not have the capability to fuse or resolder the cut and sized ring. Such a jeweler is forced to measure the customer's ring size, then send the ring to a manufacturing jeweler or the like in order to have the ring sized. Consequently the jeweler without a manufacturing capability looses the precious metal taken from a ring which is to be decreased in size by the manufacturing jeweler. Although an accounting process is possible, it would be appropriate for the retailing jeweler to have a cutter which could shear out a section of the ring to be decreased in size equal to the amount which must be removed from the ring. The retailing jeweler could then send the sheared ring to the manufacturing jeweler for soldering or fusing. When increasing the size of the ring, the retailing jeweler could similarly shear out a narrow section of the ring and provide that section along with additional precious metal to the manufacturing jeweler to increase the size of the ring. In addition to use by a retailing jeweler the manufacturing jeweler could use such a tool in the same manner so that minimum wastage occurs in cutting the ring.

SUMMARY OF THE INVENTION

Accordingly, this invention provides a relatively simple tool for shearing rings made of precious metal.

It is an object of this invention to provide an easily manufactured cutting tool for decorative rings.

It is a further object of this invention to provide a cutting tool for decorative rings which removes sections of predetermined sizes from the ring.

It is still another object of this invention to provide a cutting tool which accomplishes the above-described objects and which may be used with little training.

Broadly stated, this invention is a cutting tool comprising a base member and at least two substantially identically formed cutting blocks each cutting block fixed to the base. The cutting edges of the cutting blocks being in a parallel facing arrangement while the cutting blocks are affixed to the base. A cutting blade of predetermined thickness defines a pair of cutting edges. The tool includes a spindle mounted for rotation in the cutting block with the cutting blade mounted on the spindle intermediate of the cutting blocks. The cutting blade is rotatable with the spindle to bring the pair of blade cutting edges into a simultaneous shearing relation with the cutting edges of the adjacent cutting blocks. The invention also includes means for rotating the sprindle.

A BRIEF DESCRIPTION OF THE DRAWINGS

The above-described objects and other objects will become apparent from the following specification and the attached drawings in which:

FIG. 1 is a perspective view of a cutting tool in accord with the invention.

FIG. 2 is a side elevation view partly in section of the cutting tool shown in FIG. 1.

FIG. 3 is a section view taken at Line III-III of FIG. 2 showing a blade of the cutting tool described herein.

FIG. 4 is a partial elevation of an alternate embodiment of a bearing member used in the cutting block.

DETAILED DESCRIPTION OF THE PREFERRED EMBODIMENT

Referring to FIG. 1, a cutting tool 10 in accord with the present invention is shown. A ring 12, which does not form a portion of the invention is shown positioned in the cutting tool in a manner such that a section of predetermined size could be cut from the ring. This will become apparent from a description of the operation of this tool.

Cutting tool 10 is comprised of a base member 14 which may be formed with a plurality of mounting holes 15 to enable the cutting tool to be affixed to a bench. Affixed to base 14 are a plurality of cutting blocks 16, each with attachment means such as bolt 17. Although all the cutting blocks are substantially the same, reference will be made to the cutting blocks positioned at each end of the tool as 16' and 16" to avoid confusion. Each cutting block 16 is formed with a base portion 18 having a generally rectangular cross section thus forming a parallelepiped. Upstanding from base portion 18 and unitarily formed therewith is an upper portion 19 which has a generally triangular cross section with a truncated apex. Each cutting block 16 is transpierced by a bore 20 having an axis parallel to and slightly above the plane of the top surface 40 of the base portion. Interposed between each pair of cutting blocks 16 is a cutting blade 22 which may be formed in the generally circular shape shown in FIG. 3 and which has a noncircular aperture such as a square 23 piercing the circular plate-like blade 22 and aligned with the axis thereof. The thickness of each cutting blade 22 is predetermined and may vary from a thin blade to a relatively thick blade. This will become more apparent in a discussion of the operation of the cutting tool. A spindle 24 passes through the aligned bores 20 of the mounted cutting blocks 16 and has mounted thereon for rotation therewith the blades 22, each blade intermediate of two cutting blocks. The noncircular aperture 23 of each blade 22 is formed to fit the center portion 25 of spindle 24.

The center portion 25 of the spindle 24 is formed with a rectangular cross section substantially the same dimensions as the square aperture transpiercing each blade 22 thus resulting in rotation of blade 22 upon rotation of spindle 24. The ends 21 of spindle 24 are circular in cross section to allow bearing means to be inserted between the two end cutting blocks 16 and the spindle 24. Spindle 24 has at one end a threaded portion 26 wherein jam nuts 27 may be threadably positioned. Interposed between jam nuts 27 and the end block 16' may be a washer 28 of a conventional design. A bearing 29 is interposed in end block 16' and encompassing circular end 21. This bearing 29 allows free rotation of spindle 24 in the plurality of blocks 16. At the other opposite end of spindle 24, a similar bearing 30 is positioned in end block 16''' in the manner of bearing 29 to serve the same purpose. Again, spindle 24 is formed with a cylindrical portion specifically to rotate within bearing 30. A washer 31 may be disposed between end block 16'' and a handle 32 affixed to spindle 24 by conventional means such as a key 34. Finally a nut 33 may be disposed on a threaded extension 24 to insure retention of handle 32 thereon.

The bores 20 through each individual cutting block 16 are made slightly larger than the diagonal measurement of the square center portion 25 of spindle 24 thus allowing rotation of the spindle within the plurality of cutting blocks which do not include bearings.

Each individual cutting blade 22 is formed with a pair of opposed notches 36 and 37 (see FIG. 3). Each opposed notch 36 and 37 defines one surface 38 and 39 respectively. Each surface 38 and 39 defines a pair of cutting edges 42 and 43. The plane of the surfaces 38 and 39 lie on a plane of a sector of the circular cutting blade and which is parallel to the diameter of the circular blade 22. Thus it can be seen in FIG. 3 that the cutting surfaces 38 and 39 and the upper surface 40 of lower portion 18 of the cutting blocks 16 are not coplaner but rather upon rotation of the blade the plane of the surface 38 or the surface 39 will intersect the plane of upper surface 40 of the base portion 18 of the cutting blocks at an angle so that edges 42 and 43 of the cutting blade cooperating with edges 44 and 45 of the adjacent cutting blocks may shear material that is softer than the material the cutting blocks are manufactured from. In view of the fact that this tool is envisioned to be used with the softer precious metals, such as gold, silver and platinum, the blades 22 and the cutting blocks 16 are made of a material sufficiently hard to retain a cutting capability. It has been sufficiently hard to retain a cutting capacility. It has been found that heat treated tool steel is sufficiently hard to serve this purpose.

The tool is envisioned to be used with receptacles 41, which are positionable adjacent the plurality of cutting blocks 16 to catch the small segment of a ring which is sheared out by rotation of the cutting blade 22.

In operation, the cutting tool 10 is positioned on a jeweler's bench through the use of the bolts passing through mounting holes 15. The jeweler then positions the ring, such as ring 12, in an appropriate dimensioned blade. It should be pointed out that the blades 22 are increasing in size and may correspond to the steps between ring sizes commonly used in the jewelery trade. Thus, if the narrowest blade 22 corresponds to one quarter ring size, the next adjacent blade would correspond to one half a ring size and so on. Therefore if the jeweler wished to take out three quarters of a ring size he would position the ring as indicated in FIG. 1 and rotate handle 32 in a clockwise direction causing edges 42 and 43 of the cutting surface 38 to contact the ring 12. The edges 42 and 43 simultaneously come into a shearing relation with cutting edges 44 and 45 formed on the upper surface 40 of the adjacent cutting blocks 16. Due to the nature of the material that the cutting tool is made of, a portion of ring 12 which would be substantially softer will be sheared out equal in size to the thickness of the appropriate blade 22. The handle 32 may then be rotated in a counterclockwise direction to free the ring from the cutting blade and also to free the portion of the ring 12 from between the adjacent cutting blocks 16 and allow the sheared portion to drop to the receptacle 41 for salvage.

Two notches 36 and 37 are provided in each blade 22 for one of several reasons. First the two notches 32 allow convenient righthanded or lefthanded operation of the cutting tool by different jewelers. Furthermore, positioning the handle at one end may require rotation in only one direction when the tool is positioned on a jeweler's bench. Finally, and most important, if the tool is used by a righthanded jeweler for example and rotation is always as shown in FIG. 1 when the blades become somewhat dull after a period of use, the machine may be disassembled and the cutting blocks and blades reversed thus obtaining a new cutting edge without buying a new machine or new blades. Similarly, individual blades as they become dull may be reversed in the same manner.

A portion of a cutting block 16*a* which is an alternate design for the cutting block shown in the primary embodiment is illustrated in FIG. 4. In block 16*a* the bore 20*a* of the cutting block is purposely made larger than the diagonal of the square center portion 25 of spindle 24. This permits insertion of a sleeve 48 having a cylindrical outer surface and a square aperture transpiercing the sleeve which is adapted to fit the spindle 24 at the center square portion 25. Operation of the spindle in this particular embodiment is identical to that in the primary embodiment, however rotation of spindle 24 causes the sleeves 48 to follow and act as bearings to each individual cutting block 16*a*. This embodiment provides more support through the length of the spindle and could be used with heavier blades.

Although this invention has been described in relation to a particular embodiment it is to be understood that it is limited only as described in the accompanying claims.

We claim:

1. A cutting tool comprising:

a base member;

two substantially identically formed cutting blocks each defining at least one block cutting edge, said cutting blocks affixed to said base with said cutting edges in a parallel facing arrangement;

a spindle;

a cutting blade of predetermined thickness, said cutting blade defining a pair of blade cutting edges;

said cutting blocks defining a bore therethrough to rotatingly receive said spindle, and said cutting blade mounted on said spindle intermediate of said cutting blocks said cutting blade rotatable with said spindle to bring said pair of blade cutting edges into a simultaneous shearing relation with said cutting edges of said cutting blocks;

means for rotating said spindle.

2. The cutting tool of claim 1 wherein the cutting blade has a generally circular cross section and defines a square aperture transpiercing said blade and further wherein the cutting blade defines a notched perimeter, said notched perimeter forming the blade cutting edges.

3. The cutting tool of claim 2 wherein each of the cutting blocks includes a base portion having generally the shape of a rectangular parallelepiped and an upper portion unitarily formed with said base portion and upstanding from the upper one surface thereof generally at the midportion of said base portion, the axis of the bore positioned in said upper portion of predetermined distance above the plan passing through said one upper surface of said base portion.

4. The cutting tool of claim 3 wherein said spindle means comprises an elongated center portion having a square cross section and formed to fit the square aperture of the cutting blade, a threaded end portion, and a handle mounting portion at the end opposite the threaded end portion, the handle mounting portion adapted to receive the means for rotating the spindle means.

5. The cutting tool of claim 4 wherein the means for rotating spindle means comprises a handle and key means, said handle retained on said spindle by said key means.

6. The cutting tool of claim 5 further comprising receptacles abutting said cutting blocks.

7. The cutting tool of claim 1 in combination with a second cutting blade of a different predetermined thickness and defining a pair of cutting edges; and an additional cutting block defining at least one cutting edge, said second cutting blade mounted on the spindle intermediate of said additional cutting block and one of the two cutting blocks, said second cutting blade rotatable with said spindle to bring the cutting edges of the second cutting blade into simultaneous arrangement with the cutting edges of the one of the two cutting blocks, and the additional cutting block.

8. The cutting tool of claim 2 wherein the cutting blade defines a second notch in the perimeter thereof, said second notch defining a second pair of blade cutting edges.

9. The cutting tool of claim 1 further comprising bearing means positionable in the cutting blocks and acting in combination therewith to facilitate rotation of the spindle.

10. The cutting tool of claim 9 further comprising nut means received on the threaded portion of the spindle for retaining said spindle in rotation alignment with the cutting blocks.

* * * * *

UNITED STATES PATENT OFFICE

CERTIFICATE OF CORRECTION

Patent No. 4,054,073 Dated October 18, 1977

Inventor(s) Howard H. Smith et al.

It is certified that error appears in the above-identified patent and that said Letters Patent are hereby corrected as shown below:

Column 2, line 6, change "sprindle" to read -- spindle --.

Column 3, line 8, change "16'''" to read -- 16" --.

Column 3, line 42-43 delete "It has been sufficiently hard to obtain a cutting capacility".

Signed and Sealed this

Twenty-eighth Day of March 1978

[SEAL]

Attest:

RUTH C. MASON
Attesting Officer

LUTRELLE F. PARKER
Acting Commissioner of Patents and Trademarks